US010897667B2

(12) United States Patent
Lau

(10) Patent No.: US 10,897,667 B2
(45) **Date of Patent: *Jan. 19, 2021**

(54) CORRECTING FOR LATENCY OF AN AUDIO CHAIN

(71) Applicant: DTS, Inc., Calabasas, CA (US)

(72) Inventor: Dannie Lau, Los Angeles, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/515,748

(22) Filed: Jul. 18, 2019

(65) Prior Publication Data

US 2019/0342659 A1 Nov. 7, 2019

Related U.S. Application Data

(63) Continuation-in-part of application No. 16/406,601, filed on May 8, 2019, now Pat. No. 10,694,288, which is a continuation of application No. 15/617,673, filed on Jun. 8, 2017, now Pat. No. 10,334,358.

(51) Int. Cl.
*H04R 29/00* (2006.01)
*H04R 3/00* (2006.01)

(52) U.S. Cl.
CPC ..... *H04R 3/00* (2013.01); *H04R 2420/07* (2013.01); *H04R 2430/01* (2013.01)

(58) Field of Classification Search
CPC ... H04R 3/00; H04R 2420/07; H04R 2430/01
USPC ..... 381/56, 58
See application file for complete search history.

(56) References Cited

U.S. PATENT DOCUMENTS

| | | | |
|---|---|---|---|
| 7,054,544 | B1 | 5/2006 | Tanaka |
| 7,555,354 | B2 | 6/2009 | Walsh et al. |
| 8,995,240 | B1 | 3/2015 | Erven et al. |
| 9,219,460 | B2 | 12/2015 | Bush |

(Continued)

FOREIGN PATENT DOCUMENTS

WO WO-2018227103 12/2018

OTHER PUBLICATIONS

"U.S. Appl. No. 15/617,673, Final Office Action dated Sep. 4, 2018", 15 pgs.
"U.S. Appl. No. 15/617,673, Non Final Office Action dated Feb. 28, 2018", 13 pgs.
"U.S. Appl. No. 15/617,673, Notice of Allowance dated Mar. 22, 2019", 9 pgs.

(Continued)

*Primary Examiner* — Ammar T Hamid
(74) *Attorney, Agent, or Firm* — Schwegmaa Lundberg & Woessner, P.A.

(57) ABSTRACT

A user device can be used to correct for a latency of an audio chain, which extends inclusively between an input and a speaker. The user device can communicate an indication to the speaker to play a sound at a first time, and record a second time at which a microphone on the user device detects the sound. The user device can compare the first and second times to determine a latency of the audio chain. The user device can communicate adjustment data corresponding to the determined latency to a component in the audio chain. The component can use the adjustment data to correct for the determined latency. In some examples, the user device can display instructions to position the user device a specified distance from the speaker, and can account for a time-of-flight of sound to propagate along the specified distance.

20 Claims, 3 Drawing Sheets

(56) References Cited

U.S. PATENT DOCUMENTS

| | | | | |
|---|---|---|---|---|
| 9,226,087 | B2 | 12/2015 | Ramos | |
| 9,329,831 | B1 | 5/2016 | Fullerton et al. | |
| 9,330,096 | B1 | 5/2016 | Fullerton et al. | |
| 9,331,799 | B2 | 5/2016 | Gao et al. | |
| 9,363,601 | B2 | 6/2016 | Ramos | |
| 9,367,283 | B2 | 6/2016 | Kuper | |
| 10,334,358 | B2 | 6/2019 | Lau | |
| 10,694,288 | B2 | 6/2020 | Lau | |
| 2014/0177864 | A1 | 6/2014 | Kidron | |
| 2015/0078596 | A1* | 3/2015 | Sprogis | H04S 7/301 381/303 |
| 2016/0011850 | A1 | 1/2016 | Sheen et al. | |
| 2016/0080887 | A1 | 3/2016 | Tikkanen et al. | |
| 2016/0255302 | A1 | 9/2016 | Greene et al. | |
| 2017/0346588 | A1 | 11/2017 | Prins et al. | |
| 2018/0359561 | A1 | 12/2018 | Lau | |
| 2019/0268694 | A1 | 8/2019 | Lau | |

OTHER PUBLICATIONS

"U.S. Appl. No. 15/617,673, Pre-Appeal Brief filed Dec. 7, 2018", 5 pgs.
"U.S. Appl. No. 15/617,673, Response Filed May 7, 2018 to Non Final Office Action dated Feb. 28, 2018", 10 pgs.
"International Application Serial No. PCT/US2018/036680, International Search Report dated Jul. 9, 2018", 3 pgs.
"International Application Serial No. PCT/US2018/036680, Written Opinion dated Jul. 9, 2018", 6 pgs.
"U.S. Appl. No. 16/406,601, Non Final Office Action dated Nov. 29, 2019", 13 pgs.
"U.S. Appl. No. 16/406,601, Notice of Allowance dated Mar. 4, 2020", 9 pgs.
"U.S. Appl. No. 16/406,601, Response filed Feb. 14, 2020 to Non Final Office Action dated Nov. 29, 2019", 7 pgs.
"International Application Serial No. PCT/US2018/036680, International Preliminary Report on Patentability dated Dec. 19, 2019", 8 pgs.

* cited by examiner

CORRECTING FOR LATENCY OF AN AUDIO CHAIN

CROSS-REFERENCE TO RELATED APPLICATIONS

This application is a Continuation-In-Part of U.S. patent application Ser. No. 16/406,601, filed on May 8, 2019, which is a Continuation of U.S. patent application Ser. No. 15/617,673, filed on Jun. 8, 2017 and issued as U.S. Pat. No. 10,334,358 on Jun. 25, 2019, the contents of which are incorporated herein in their entireties.

FIELD OF THE DISCLOSURE

The present disclosure relates to correcting for latency, such as in a chain of audio/visual components.

BACKGROUND OF THE DISCLOSURE

An amount of latency through an audio system can depend on a chain of components that touch the audio path. For examples, a component that performs digital processing of a digital signal typically imparts a latency to the digital signal, due to the time required to perform the digital processing. In some examples, where the digital processing requires simultaneous processing of multiple frames in the digital signal, the digital processing may impart a latency that corresponds to at least the number of frames used to perform the processing. In general, each component can add latency that affects the synchronization of audio to video, or to other audio devices, in the case of a multi-room music system. The latencies from sequential chained components can add, so that a latency of the chained components, together, can exceed a latency of any individual component in the chain.

SUMMARY

One example includes a method for correcting for a latency of an audio chain, the audio chain extending inclusively between an input and a speaker, the method comprising: displaying, on a user interface on a user device, instructions to position a microphone a specified distance from the speaker; with the user device, communicating an indication to the speaker to play a sound at a first time; recording a second time at which the microphone detects the sound; with the user device, comparing the first and second times and accounting for a time-of-flight of sound to propagate along the specified distance to determine a latency of the audio chain; and with the user device, communicating adjustment data corresponding to the determined latency to at least one component in the audio chain, the adjustment data used by the at least one component in the audio chain to correct for the determined latency.

Another example includes a system, comprising: a microphone; a processor; and a memory device for storing instructions executable by the processor, the instructions being executable by the processor to perform steps for correcting for a latency of an audio chain, the audio chain extending inclusively between an input and a speaker, the steps comprising: displaying, on a user interface on a smart phone, instructions to position the microphone a specified distance from the speaker; communicating an indication to the speaker to play a sound at a first time, the first time being synchronized to a clock of a computer network; recording a second time at which the microphone detects the sound, the second time being synchronized to the clock of the computer network; comparing the first and second times and accounting for a time-of-flight of sound to propagate along the specified distance to determine a latency of the audio chain; and communicating adjustment data corresponding to the determined latency to at least one component in the audio chain, the adjustment data used by the at least one component in the audio chain to correct for the determined latency.

Another example includes a method for correcting for a latency of an audio chain, the audio chain extending inclusively between an input and a speaker, the method comprising: displaying, on a user interface on a smart phone, instructions to position a microphone a specified distance from the speaker; with the smart phone, communicating an indication to the speaker to play a sound at a first time, the first time being synchronized to a clock of a computer network; with the smart phone, timestamping a second time at which the microphone detects the sound, the second time being synchronized to the clock of the computer network; subtracting a time stamp corresponding to the second time from a time stamp corresponding to the first time, and accounting for a time-of-flight of sound to propagate along the specified distance, to determine a latency of the audio chain; and with the smart phone, communicating adjustment data corresponding to the determined latency to at least one component in the audio chain, the adjustment data used by the at least one component in the audio chain to correct for the determined latency.

BRIEF DESCRIPTION OF THE DRAWINGS

Corresponding reference characters indicate corresponding parts throughout the several views. Elements in the drawings are not necessarily drawn to scale. The configurations shown in the drawings are merely examples, and should not be construed as limiting the scope of the invention in any manner.

DETAILED DESCRIPTION

Figure 1:
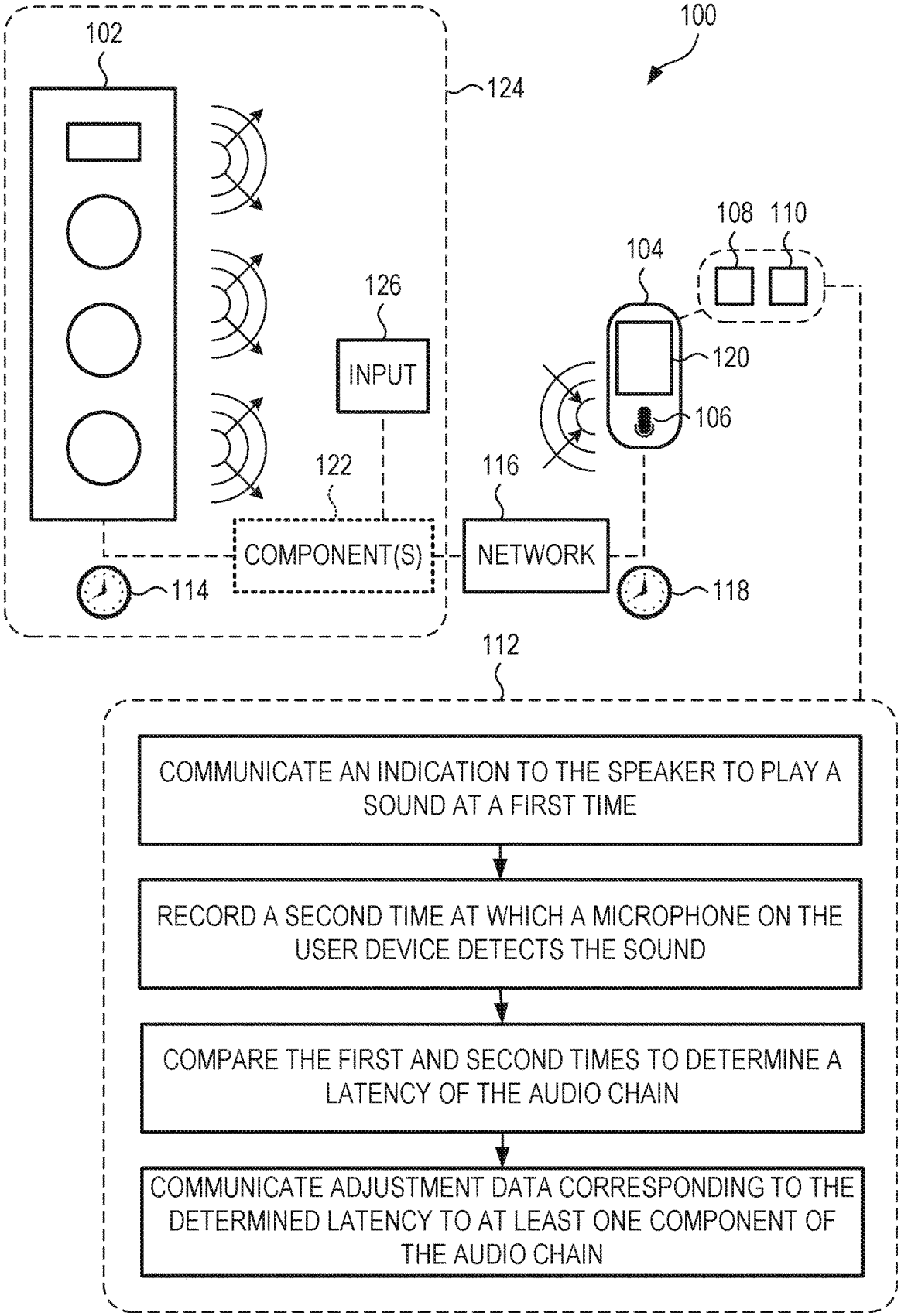
FIG. 1 shows a block diagram of a system that can correct for a latency of a speaker and/or latency of one or more additional components, in accordance with some examples.

In many audio/video configurations, there can be multiple, cascaded components that touch the audio path. These components can form an audio chain, which extends inclusively between an input, such as a streaming service or an optical disc, and a speaker. The audio chain can include optional additional components, such as a television, between the input and the speaker. The audio chain can additionally include connectors and connection protocols, such as a High-Definition Multimedia Interface, that allow the components in the audio chain to communicate with one another.

In a first example, an audio chain can include, sequentially, an input, a set top box, an audio/video receiver, a television, and a soundbar that produces output sound corresponding to the input. In a second example, an audio chain can include, sequentially, an input, a set top box, a television, a stereo component, and a speaker that produces output sound corresponding to the input. In a third example, an audio chain can include, sequentially, an input, a television, and a soundbar that produces output sound corresponding to the input. In a fourth example, an audio chain can include, sequentially, an input, a streaming stick, a television, and a soundbar that produces output sound corresponding to the input. These are but mere examples of audio chains, and other configurations can also be used.

In configurations in which one or more components touch the audio path, any or all of the components and connections can contribute to the latency of the audio signal, with respect to a video signal or to another audio signal, such as in a multi-room audio system. For example, a component can perform video processing functions, such as scaling, de-interlacing, color-space expansion, and others. In some examples, where the video processing functions can utilize video that spans multiple frames in the video stream, the video processing may impart a latency that corresponds to at least the number of frames used to perform the processing. In some examples, to ensure that audio and video remain synchronized, a system can add a delay to the audio, to compensate for delays accrued by processing the video. These are but mere examples of how components and connections can impart latency to the audio signal; other examples are also possible.

The system and method discussed herein can measure an overall latency (or net latency) for all the components and connections in the audio chain, including a speaker. The overall latency is generally a sum of the individual latencies of the components in the audio chain, including the speaker.

The system and method discussed herein can compensate for the measured overall latency by imparting a correction to one or more components in the audio chain, including the speaker. Measuring the latency and compensating for the latency in this manner can provide synchronized audio across multiple audio playback devices and/or multiple video playback devices.

As a simplistic example, if a television is the only component in audiovisual system, and the system and method discussed herein measures an audio latency of the television to be 100 milliseconds, the system and method discussed herein can impart a correction to the television to deliver the audio 100 milliseconds earlier, so that the audio can be delivered synchronized with the video and with other playback devices downstream. This is but one example; other configurations can also be used. In some of these other configurations, a component can render the audio 100 milliseconds earlier from an internal device buffer. In some of these other configurations, a component can receive instructions to render the audio 100 milliseconds later to match the 100 milliseconds delay caused by the television.

FIG. 1 shows a block diagram of a system 100 that can correct for a latency of an audio chain 124, in accordance with some examples. The audio chain can extend inclusively between an input 126, such as a streaming service or an optical disc, and a speaker 102. The audio chain can optionally include one or more additional components 122, such as a television or a receiver. The system 100 of FIG. 1 is but one example of a system 100 that can control a latency of an audio chain 124; other suitable systems can also be used.

In some examples, the speaker 102 can be one of a set top box, a television, or a soundbar. In some examples, the speaker 102 can be controlled by a High-Definition Multimedia Interface. In this example, the speaker 102 and the optional components 122 are not part of the system 100, but are in communication with the system 100 through a wired or wireless network. The system 100 can adjust, correct, or control the latency of the speaker 102 and/or the one or more optional components 122, typically to match the latency of one or more additional audio or video components.

The system 100 for controlling latency can run as an application on a user device 104. In the example of FIG. 1, the user device 104 is a smart phone. Alternatively, the user device 104 can be a tablet, laptop, computer, or any suitable device that includes a microphone 106 or can be attached to a microphone 106. It will be understood that any of these alternative user devices can be used in place of the smart phone of FIG. 1.

The user device 104 can include a processor 108 and a memory device 110 for storing instructions 112 executable by the processor 108. The processor 108 can execute the instructions 112 to perform steps to correct for a latency of the speaker 102 and/or one or more optional components 122. The steps can include communicating an indication to the speaker 102 to play a sound at a first time 114, the first time 114 being synchronized to a clock of a computer network 116; recording a second time 118 at which the microphone 106 detects the sound, the second time 118 being synchronized to the clock of the computer network 116; comparing the first and second times to determine a latency of the speaker 102 and/or one or more optional components 122; and communicating adjustment data corresponding to the determined latency to at least one component in the audio chain 124, which can include the speaker 102 and/or one or more of the optional components 122. The adjustment data can be used by the speaker 102 and/or one or more optional components 122 to correct for the determined latency.

The user device 104 can include a user interface 120 having a display. In some examples, the user device 104 can display instructions to position the user device 104 a specified distance from the speaker 102. The user device 104 can further account for a time-of-flight of sound to propagate along the specified distance. Time-of-flight refers to the amount of time a sound takes to propagate in air from the speaker 102 to the microphone 106.

These steps and others are discussed in detail below with regard to FIG. 2.

Figure 2:
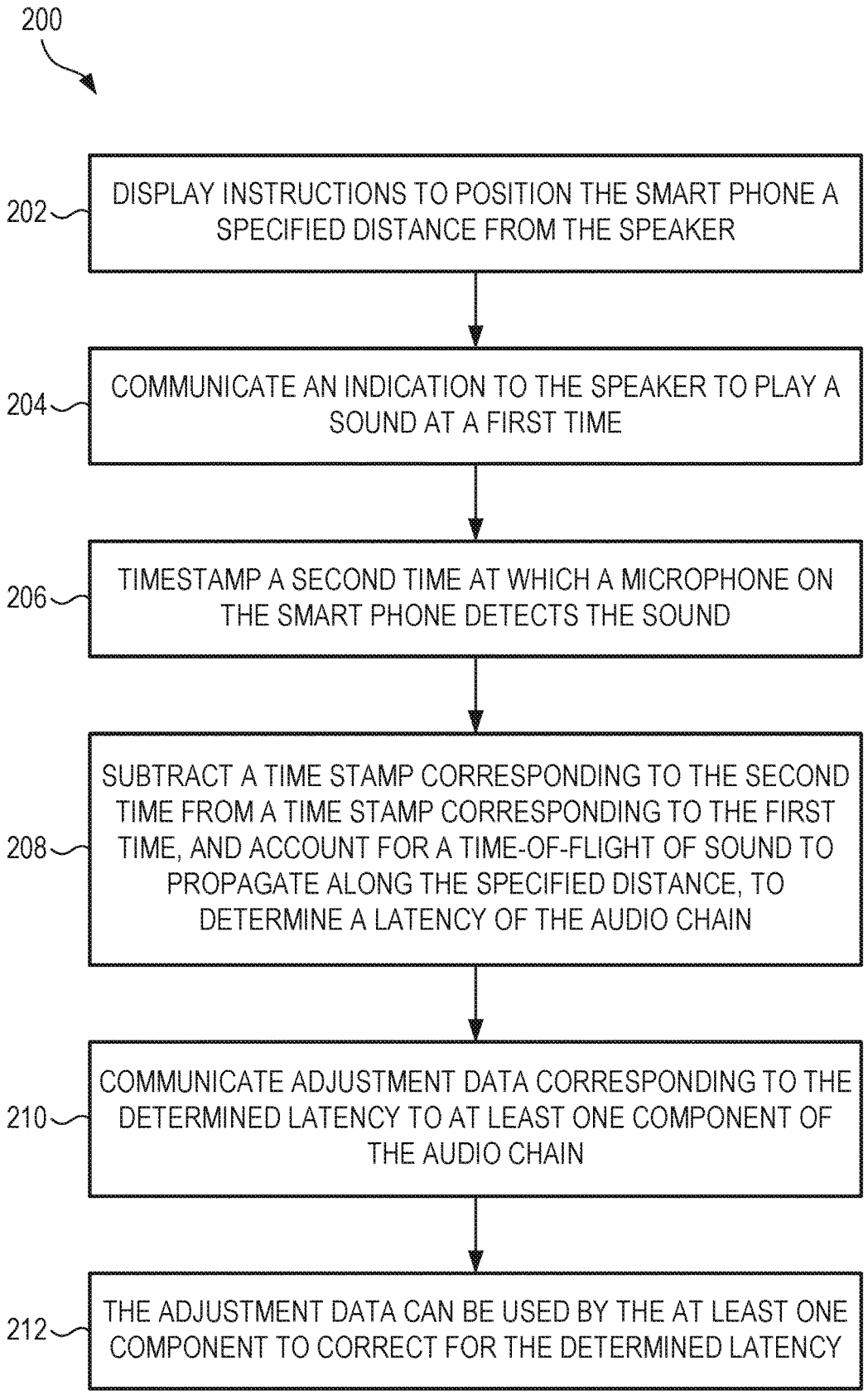
FIG. 2 shows a flowchart of an example of a method for correcting for a latency of a speaker and/or latency of one or more additional components, in accordance with some examples.

FIG. 2 shows a flowchart of an example of a method 200 for correcting for a latency of an audio chain, in accordance with some examples. The method 200 can also adjust or control a latency of the speaker and/or a latency of one or more additional components, and can optionally set the latency of the speaker and/or the one or more additional components to match the latency of one or more additional audio or visual components. In some examples, the latency can be compensated by adjusting a latency of just one component or the speaker. In other examples, the latency can be compensated by adjusting the latencies of two or more components, or one or more components plus the speaker. For example, if an audio chain latency is larger than a latency that can be easily accommodated by a single component. the latency of a first component can be adjusted to compensate for half the measured latency, while the latency of a second component can be adjusted to compensate for the other half of the measured latency. Other values can also be used. In some examples, the method 200 can be executed by a software application stored locally on a user device. In the specific example that follows, the method 200 is executed by a smart phone, but it will be understood that the method 200 can alternatively be executed by a tablet, a laptop, a computer, a computing device, or another suitable user device.

At operation 202, the smart phone can display, on a user interface on the smart phone, instructions to position the smart phone a specified distance from the speaker. For instance, the display on the smart phone can present instructions to position the smart phone one meter away from the speaker, and can present a button to be pressed by the user when the smart phone is suitably positioned. Other user interface features can also be used.

At operation 204, the smart phone can communicate an indication to the speaker to play a sound at a first time. For example, the indication can include instructions to play the sound at a specified first time in the future. In some examples the first time can be synchronized to a clock of a computer network. In some examples, the first time can be synchronized to an absolute time standard determined by the computer network. For example, the first time can be synchronized to the absolute time standard, such as a Precision Time Protocol, or by another suitable protocol. In other examples, the first time can be synchronized to a relative time standard communicated via the computer network. For example, the relative time standard can be determined by the smart phone, the speaker, or another element not controlled directly by the computer network. In some of these examples using the relative time standard, two or more devices can negotiate an agreed shard clock.

At operation 206, the smart phone can timestamp a second time at which a microphone on the smart phone detects the sound. In some examples, the second time can be synchronized to the clock of the computer network, optionally in the same manner as the first time. In some examples, the second time can be synchronized to an absolute time standard determined by the computer network, such as via a Precision Time Protocol. In other examples, the second time can be synchronized to a relative time standard communicated via the computer network. In other examples, the first and second times can be synchronized to one another without using a network-based time, such as by using a Network Time Protocol or another suitable technique.

At operation 208, the smart phone can subtract a time stamp corresponding to the second time from a time stamp corresponding to the first time, to determine a latency of the speaker and any optional additional components in the audio chain from the input to the speaker. In some examples, the smart phone can additionally account for a time-of-flight of sound to propagate along the specified distance, to determine the latency of the speaker. For example, if the smart phone is positioned one meter from the speaker, the time-of-flight can be expressed as the quantity, one meter, divided by the speed of sound in air, approximately 344 meters per second, to give a time-of-flight of about 2.9 milliseconds.

At operation 210, the smart phone can communicate adjustment data corresponding to the determined latency to the speaker and/or to any or all of the optional additional components in the audio chain from the input to the speaker. The speaker and/or any or all of the optional additional components can use the adjustment data to correct for the determined latency. By adjusting or controlling the latency in this manner, the latency of the speaker and the optional components, taken together, can optionally be set to match the latency of one or more additional audio or visual components.

Figure 3:
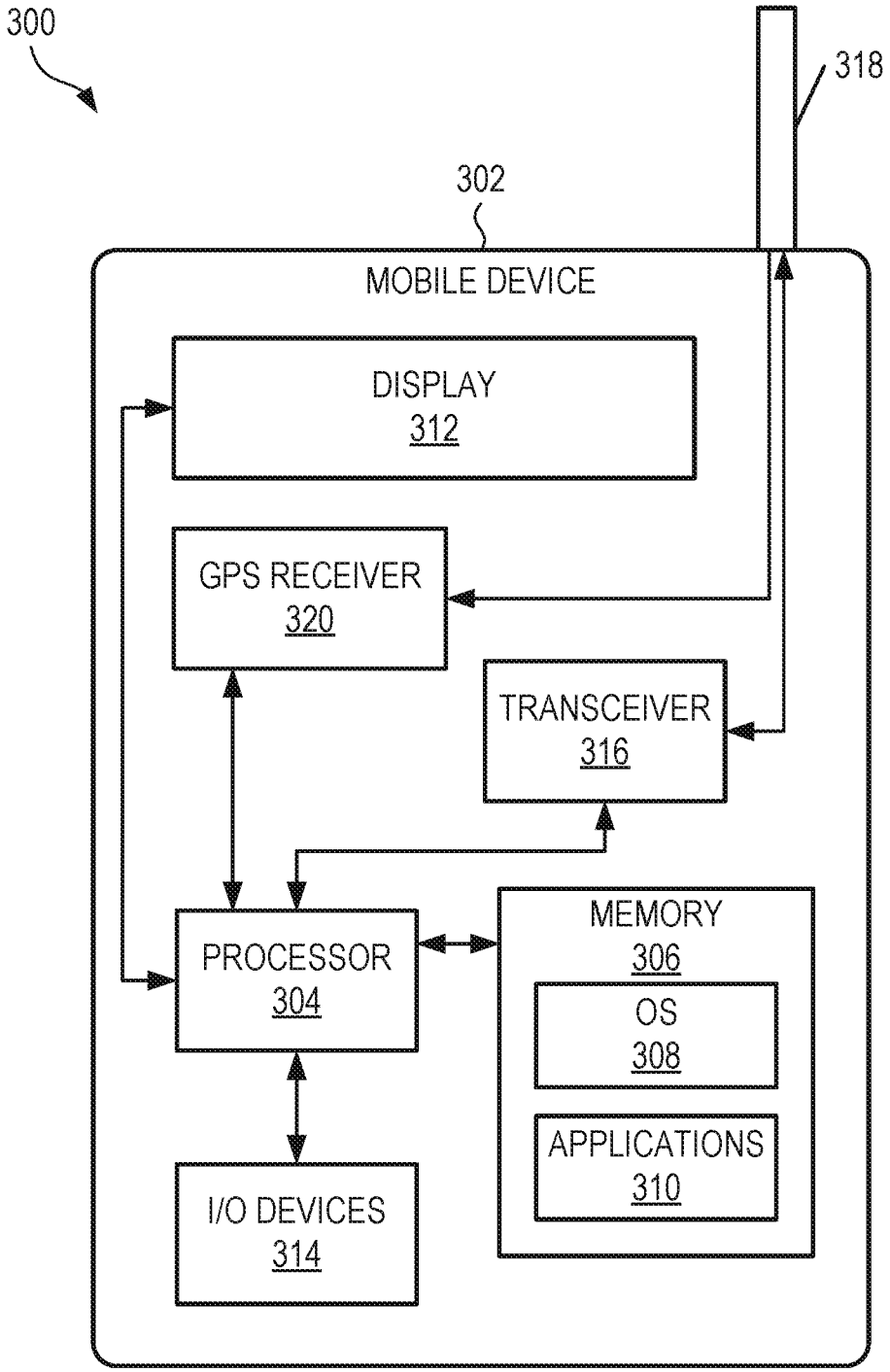
FIG. 3 is a block diagram showing an example of a latency-adjustment system that can be used to correct for a latency of a speaker and/or latency of one or more additional components, in accordance with some examples.

FIG. 3 is a block diagram showing an example of a latency-adjustment system 300 that can be used to correct for a latency of an audio chain, in accordance with some examples.

In some examples, the latency-adjustment system 300 can be configured as software executable on a user device, such as a smart phone, a tablet, a laptop, a computer, or another suitable device. In the specific example of FIG. 3, the latency-adjustment system 300 includes a software application that can run on a mobile device 302, such as a smart phone.

The latency-adjustment system 300 can include a processor 304, and a memory device 306 storing instructions executable by the processor 304. The instructions can be executed by the processor 304 to perform a method for correcting for a latency of an audio chain.

The mobile device 302 can include a processor 304. The processor 304 may be any of a variety of different types of commercially available processors 304 suitable for mobile devices 302 (for example, an XScale architecture microprocessor, a microprocessor without interlocked pipeline stages (MIPS) architecture processor, or another type of processor 304). A memory 306, such as a random access memory (RAM), a flash memory, or other type of memory, is typically accessible to the processor 304. The memory 306 may be adapted to store an operating system (OS) 308, as well as application programs 310, such as a mobile location enabled application. In some examples, the memory 306 can be used to store the lookup table discussed above. The processor 304 may be coupled, either directly or via appropriate intermediary hardware, to a display 312 and to one or more input/output (I/O) devices 314, such as a keypad, a touch panel sensor, a microphone, and the like. In some examples, the display 312 can be a touch display that presents the user interface to a user. The touch display can also receive suitable input from the user. Similarly, in some examples, the processor 304 may be coupled to a transceiver 316 that interfaces with an antenna 318. The transceiver 316 may be configured to both transmit and receive cellular network signals, wireless data signals, or other types of signals via the antenna 318, depending on the nature of the mobile device 302. Further, in some configurations, a GPS receiver 320 may also make use of the antenna 318 to receive GPS signals. In some examples, the transceiver 316 can transmit signals over a wireless network that correspond to logical volume levels for respective speakers in a multi-speaker system.

The techniques discussed above are applicable to a speaker, but can also be applied to other sound-producing devices, such as a set-top box, an audio receiver, a video receiver, an audio/video receiver, or a headphone jack of a device.

While this invention has been described as having example designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for correcting for a latency of an audio chain, the audio chain extending inclusively between an input and a speaker, the method comprising:

displaying, on a user interface on a user device, instructions to position a microphone a specified distance from the speaker;

with the user device, communicating an indication to the speaker to play a sound at a first time;

recording a second time at which the microphone detects the sound;

with the user device, comparing the first and second times and accounting for a time-of-flight of sound to propagate along the specified distance to determine a latency of the audio chain; and with the user device, communicating adjustment data corresponding to the determined latency to at least one component in the audio chain, the adjustment data used by the at least one component in the audio chain to correct for the determined latency.

2. The method of claim 1, wherein the first and second times are synchronized to a clock of a computer network.

3. The method of claim 2, wherein recording the second time at which the microphone detects the sound comprises:

time stamping a signal produced by the microphone.

4. The method of claim 3, wherein comparing the first and second times to determine the latency of the speaker comprises:

subtracting a time stamp of the signal produced by the microphone from a time stamp corresponding to the first time.

5. The method of claim 2, wherein the speaker is one of a set op box, a television, or a soundbar.

6. The method of claim 2, wherein the speaker is controlled by a High-Definition Multimedia Interface.

7. The method of claim 2, wherein the user device is a smart phone.

8. The method of claim 2, wherein the first time and the second time are synchronized to an absolute time standard determined by the computer network.

9. The method of claim 8, wherein the first time and the second time are synchronized to the absolute time standard via a Precision Time Protocol.

10. The method of claim 2 wherein the first time and the second time are synchronized to a relative time standard communicated via the computer network.

11. The method of claim 2, further comprising:

with the user device, communicating adjustment data to the speaker used by the speaker to correct for the determined latency.

12. A system, comprising:

a microphone;

a processor; and a memory device for storing instructions executable by the processor, the instructions being executable by the processor to perform steps for correcting for a latency of an audio chain, the audio chain extending inclusively between an input and a speaker, the steps comprising:

displaying, on a user interface on a smart phone, instructions to position the microphone a specified distance from the speaker;

communicating an indication to the speaker to play a sound at a first time, the first time being synchronized to a clock of a computer network;

recording a second time at which the microphone detects the sound, the second time being synchronized to the clock of the computer network;

comparing the first and second times and accounting for a time-of-flight of sound to propagate along the specified distance to determine a latency of the audio chain; and communicating adjustment data corresponding to the determined latency to at least one component in the audio chain, the adjustment data used by the at least one component in the audio chain to correct for the determined latency.

13. The system of claim 12, wherein the speaker is one of a set top box, a television, or a soundbar.

14. The system of claim 12, wherein the speaker is controlled by a High-Definition Multimedia Interface.

15. The system of claim 12, wherein the first time and the second time are synchronized to an absolute time standard determined by the computer network via a Precision Time Protocol.

16. A method for correcting for a latency of an audio chain, the audio chain extending inclusively between an input and a speaker, the method comprising:

displaying, on a user interface on a smart phone, instructions to position a microphone a specified distance from the speaker;

with the smart phone; communicating an indication to the speaker to play a sound at a first time, the first time being synchronized to a clock of a computer network;

with the smart phone, timestamping a second time at which the microphone detects the sound, the second time being synchronized to the clock of the computer network;

subtracting a time stamp corresponding to the second time from a time stamp corresponding to the first time, and accounting for a time-of-flight of sound to propagate along the specified distance, to determine a latency of the audio chain; and with the smart phone, communicating adjustment data corresponding to the determined latency to at least one component in the audio chain, the adjustment data used by the at least one component in the audio chain to correct for the determined latency.

17. The method of claim 16, wherein the speaker is controlled by a High-Definition Multimedia Interface.

18. The method of claim 16, wherein the first time and the second time are synchronized to an absolute time standard determined by the computer network.

19. The method of claim 18, wherein the first time and the second time are synchronized to the absolute time standard via a Precision Time Protocol.

20. The method of claim 16, wherein the first time and the second time are synchronized to a relative time standard communicated via the computer network.

* * * * *